US007518559B2

(12) United States Patent
Yun et al.

(10) Patent No.: US 7,518,559 B2
(45) Date of Patent: Apr. 14, 2009

(54) INVERTED L-SHAPED ANTENNA

(75) Inventors: Je-Hoon Yun, Daejon (KR); Jae-Wook Lee, Daejon (KR); Hyung-Soo Lee, Daejon (KR); Chang-Joo Kim, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 223 days.

(21) Appl. No.: 10/584,009

(22) PCT Filed: May 29, 2004

(86) PCT No.: PCT/KR2004/001282

§ 371 (c)(1),
(2), (4) Date: Jun. 22, 2006

(87) PCT Pub. No.: WO2005/062423

PCT Pub. Date: Jul. 7, 2005

(65) Prior Publication Data

US 2007/0252772 A1 Nov. 1, 2007

(30) Foreign Application Priority Data

Dec. 24, 2003 (KR) ..... 10-2003-0096884

(51) Int. Cl.
*H01Q 1/24* (2006.01)

(52) U.S. Cl. ..... 343/702

(58) Field of Classification Search ..... 343/702, 343/700 MS, 725, 767

See application file for complete search history.

(56) References Cited

U.S. PATENT DOCUMENTS

| | | | | |
|---|---|---|---|---|
| 5,835,063 | A | 11/1998 | Brachat et al. | |
| 6,025,805 | A | 2/2000 | Smith et al. | |
| 6,268,831 | B1 | 7/2001 | Sanford | |
| 6,400,329 | B1 | 6/2002 | Barnes | |
| 6,670,923 | B1 * | 12/2003 | Kadambi et al. | 343/700 MS |
| 6,819,290 | B2 * | 11/2004 | Hani et al. | 343/700 MS |
| 6,874,222 | B2 * | 4/2005 | Lebaric et al. | 29/600 |
| 6,950,069 | B2 * | 9/2005 | Gaucher et al. | 343/702 |
| 2002/0101381 | A1 * | 8/2002 | Segerstedt | 343/702 |
| 2002/0122005 | A1 | 9/2002 | Lebaric et al. | |

(Continued)

FOREIGN PATENT DOCUMENTS

EP 0757405 2/1997

(Continued)

OTHER PUBLICATIONS

'Ultra-wideband microstrip quasi-horn antenna' Nguyen et al., Electronic Letters, vol. 37, No. 12, Jun. 7, 2001, pp. 731-732.

(Continued)

*Primary Examiner*—Huedung Mancuso
(74) *Attorney, Agent, or Firm*—Ladas & Parry LLP

(57) ABSTRACT

The inverted L antenna with fixed polarization is disclosed. The inverted L antenna with fixed polarization includes: a printed circuit board (PCB) including an metal layer, a dielectric layer and a ground layer; and an antenna element coupled to a predetermined shaped of one side of the PCB, wherein the predetermined shape is a form for directing an electric field excited at edge of PCB to match with a direction of the antenna element.

15 Claims, 12 Drawing Sheets

U.S. PATENT DOCUMENTS

| | | | | |
|---|---|---|---|---|
| 2003/0222823 | A1* | 12/2003 | Flint et al. | 343/702 |
| 2004/0212545 | A1* | 10/2004 | Li et al. | 343/866 |
| 2007/0236400 | A1* | 10/2007 | Rentz | 343/753 |

FOREIGN PATENT DOCUMENTS

| | | |
|---|---|---|
| JP | 2002 185238 | 6/2002 |

OTHER PUBLICATIONS

'N Antennas and Their Applications in Portable Headsets' Pan et al., IEEE Transactions On Antennas And Propagation, vol. 45, No. 10, Oct. 1997, pp. 1475-1483.

* cited by examiner

[Fig. 1]
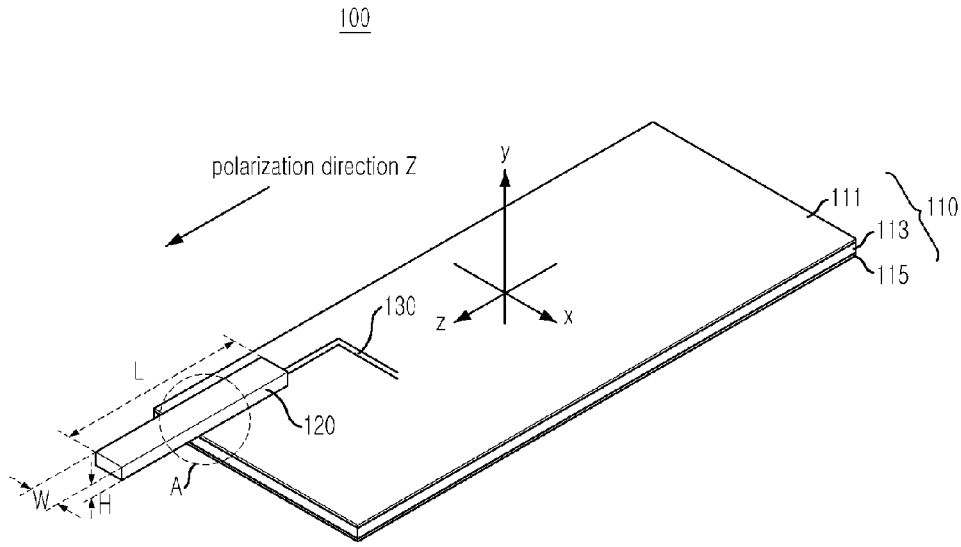
[Fig. 2]
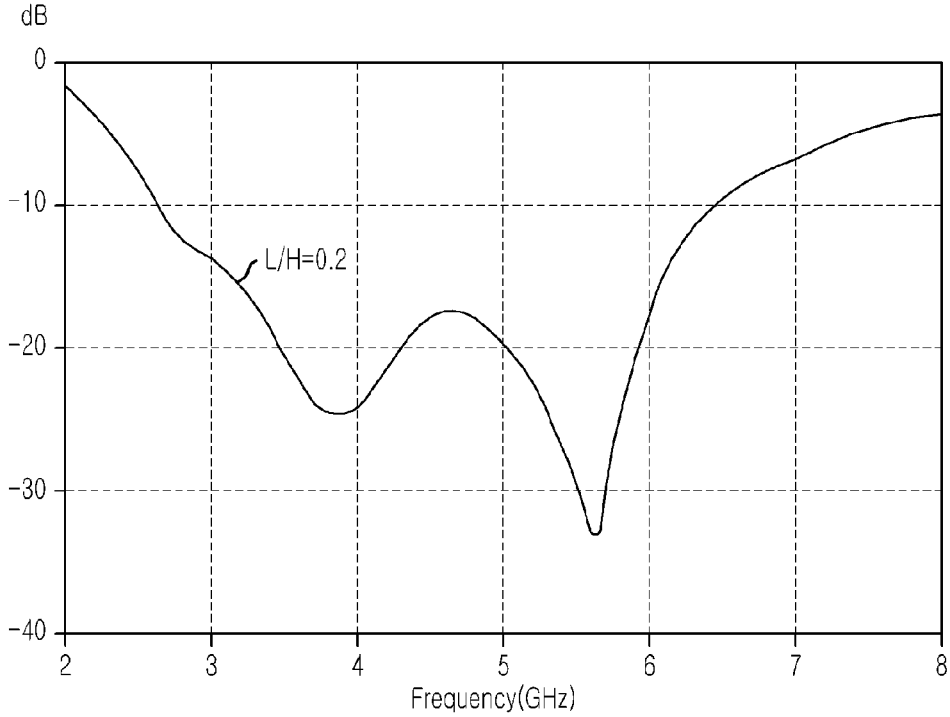

[Fig. 3]
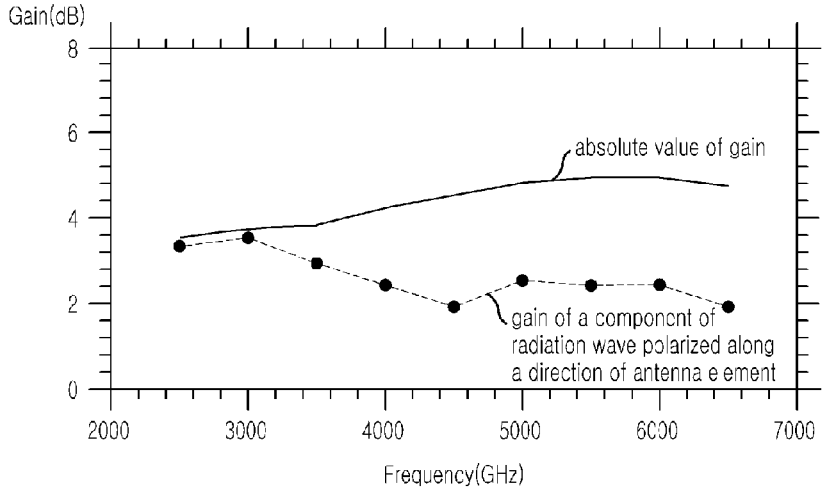
[Fig. 4]
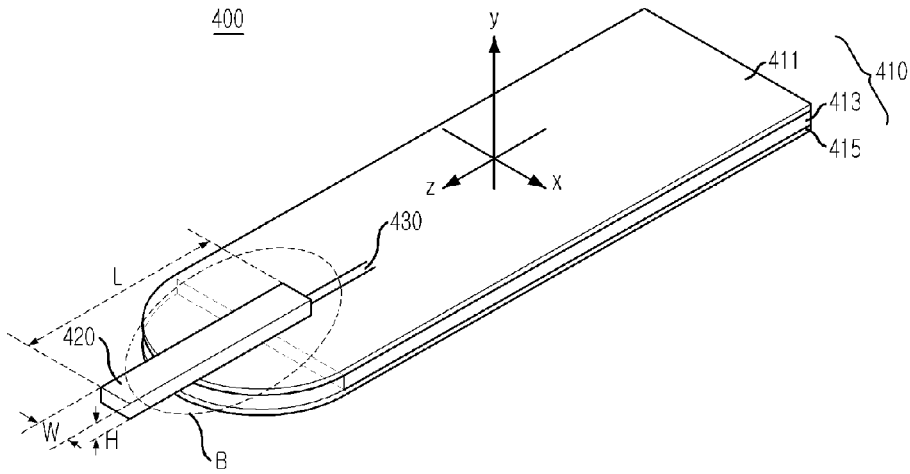

[Fig. 5]
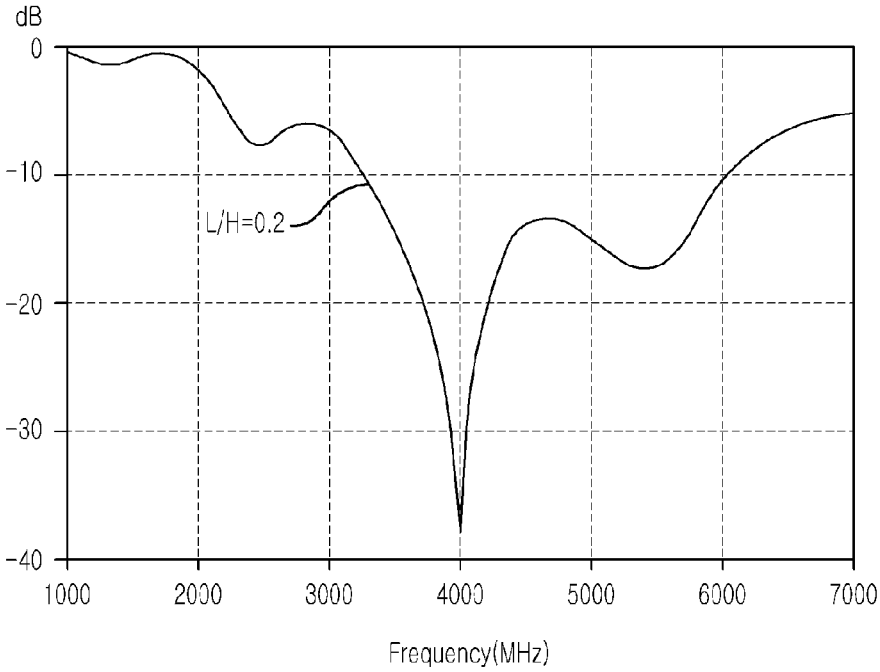
[Fig. 6]
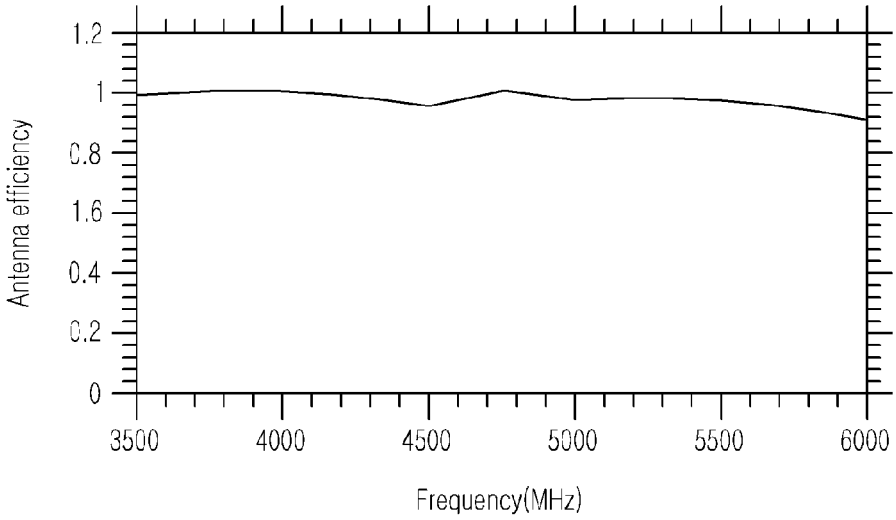

[Fig. 7]
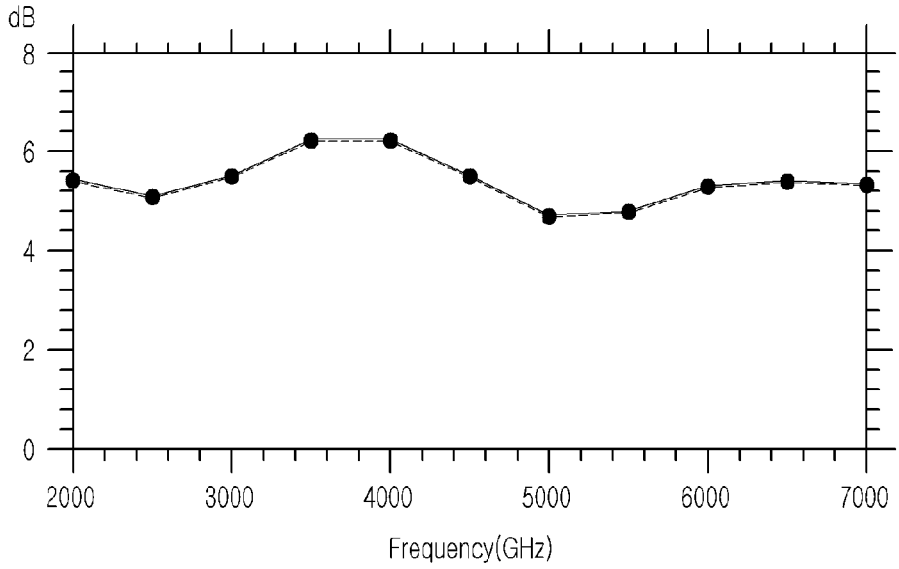
[Fig. 8]
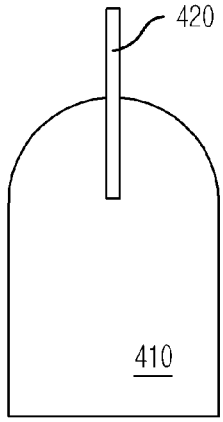

[Fig. 9]
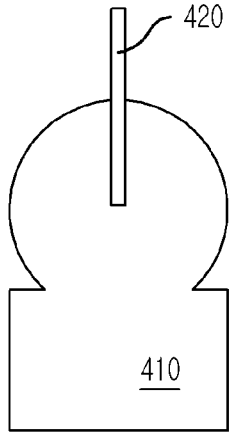
[Fig. 10]
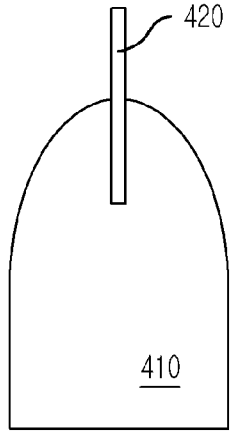
[Fig. 11]
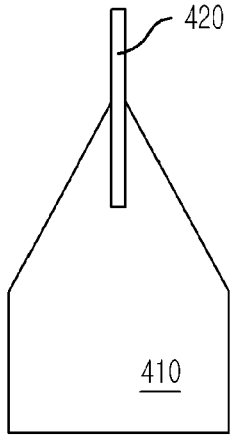

[Fig. 12]
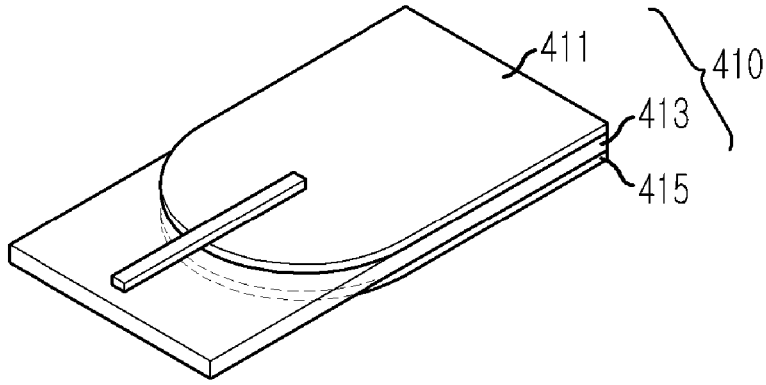
[Fig. 13]
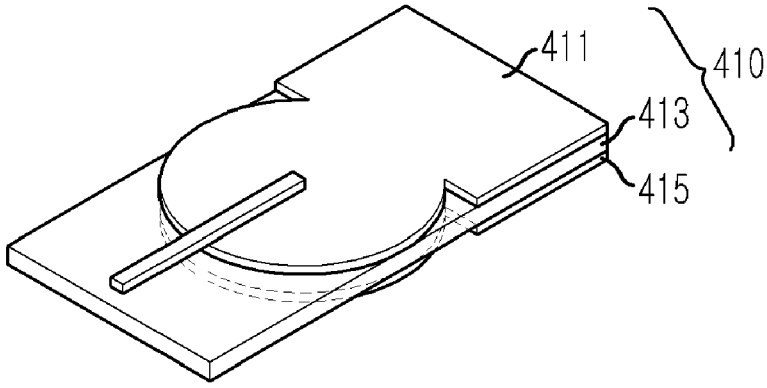
[Fig. 14]
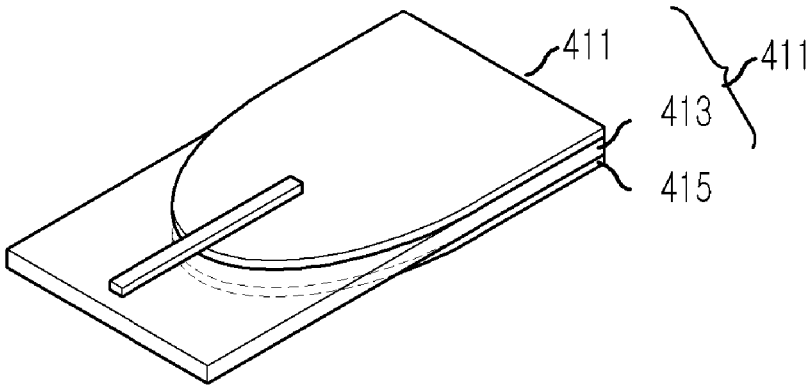

[Fig. 15]
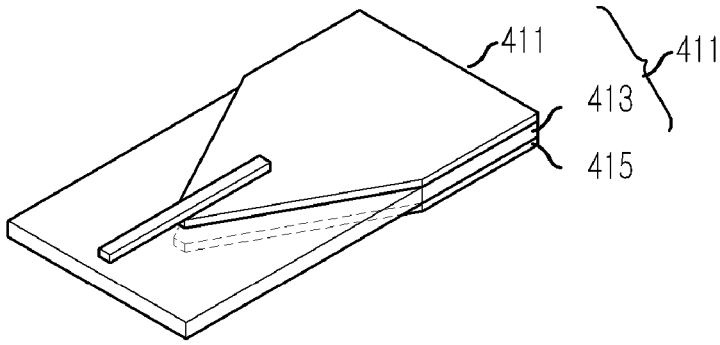
[Fig. 16]
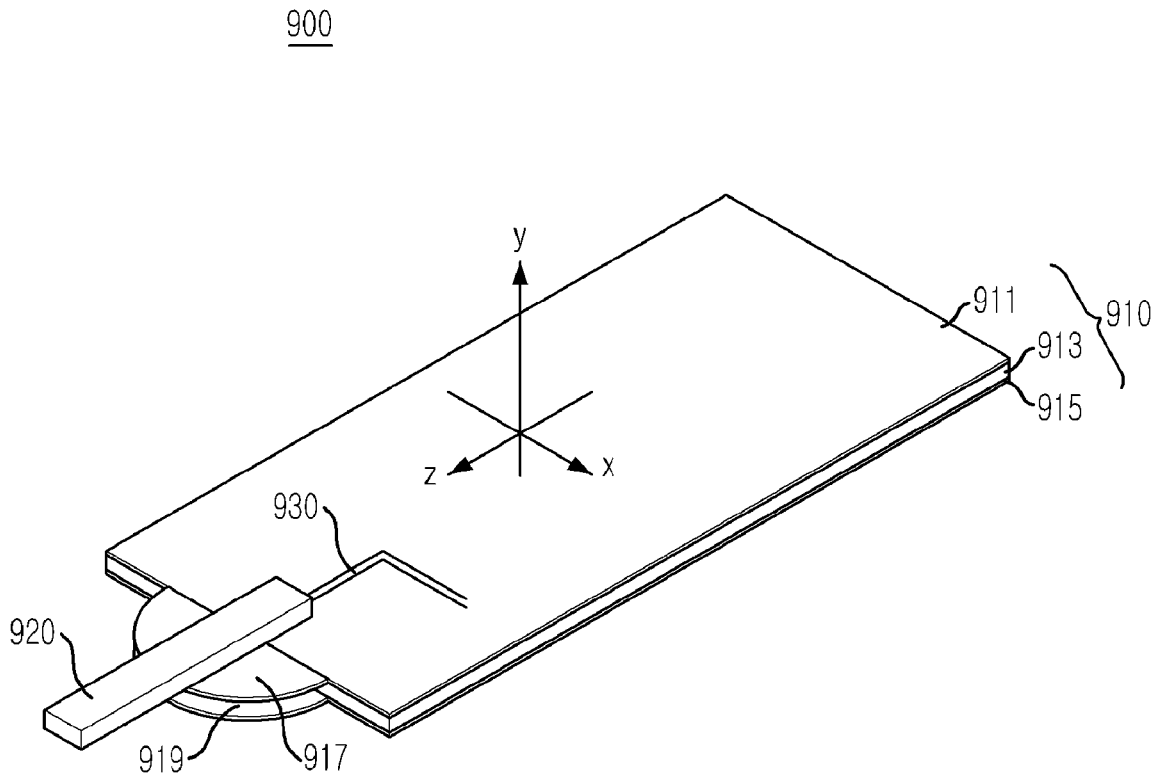

[Fig. 17]
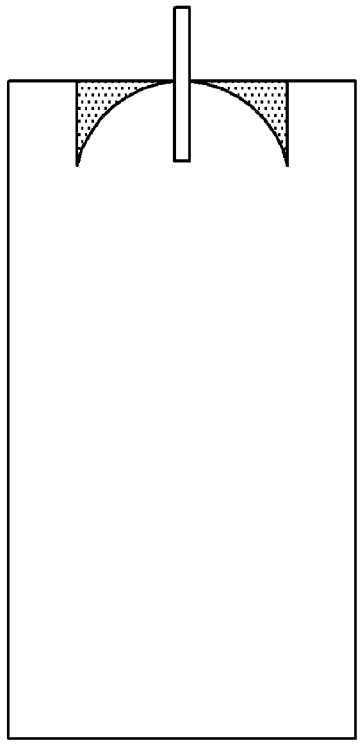
[Fig. 18]
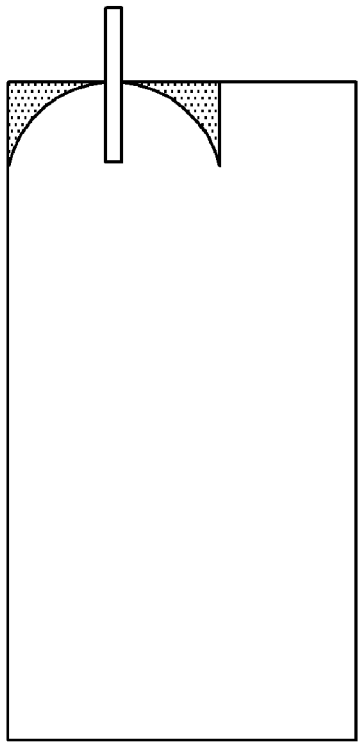

[Fig. 19]
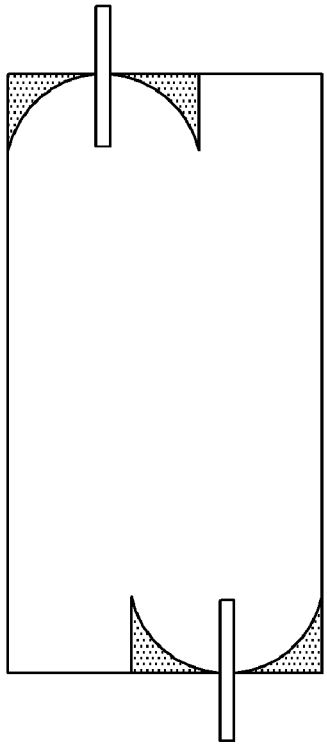
[Fig. 20]
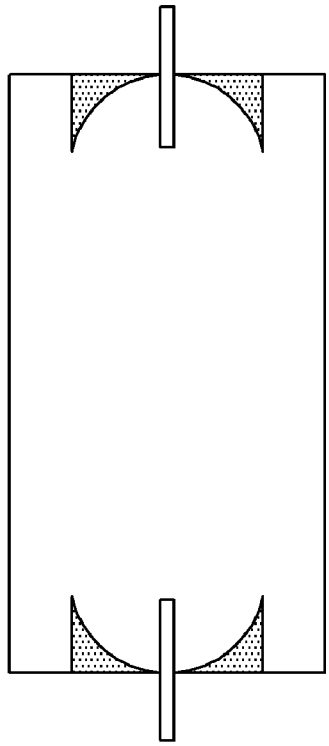

[Fig. 21]
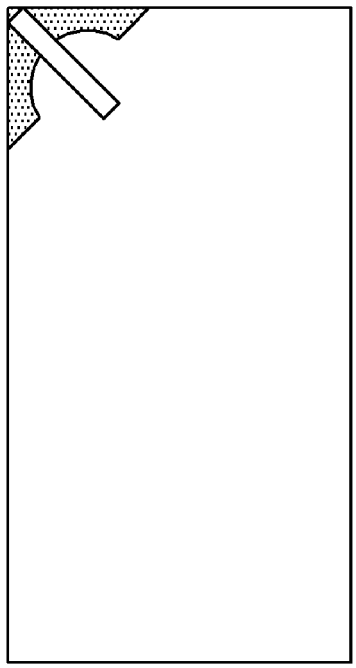
[Fig. 22]
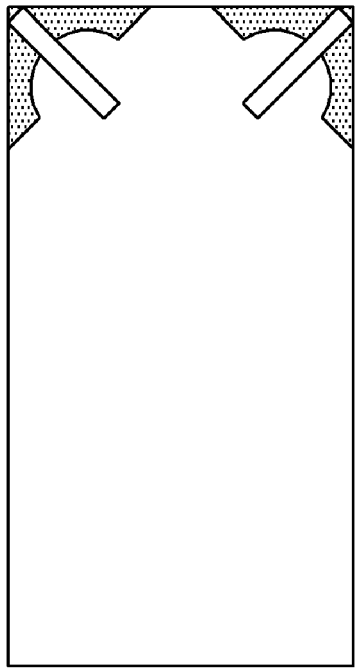

[Fig. 23]
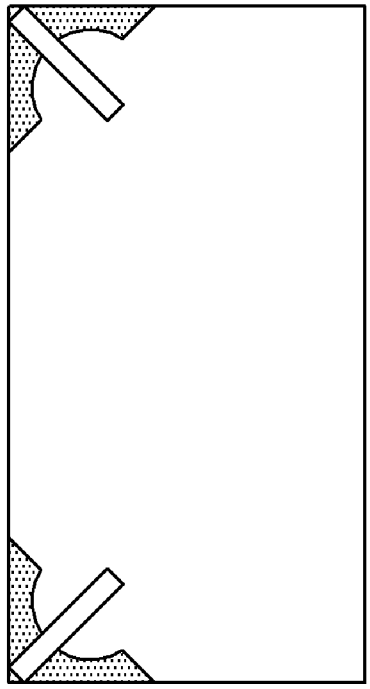
[Fig. 24]
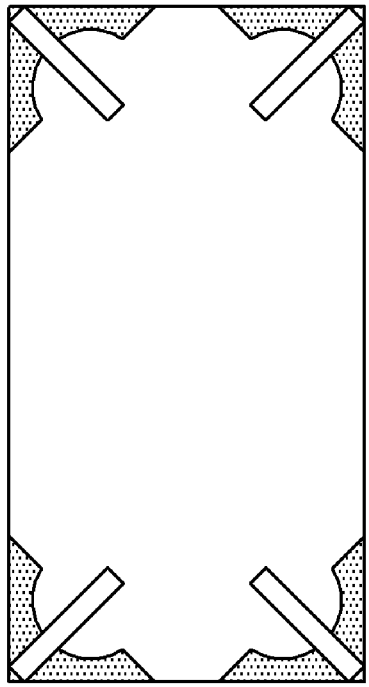

[Fig. 25]
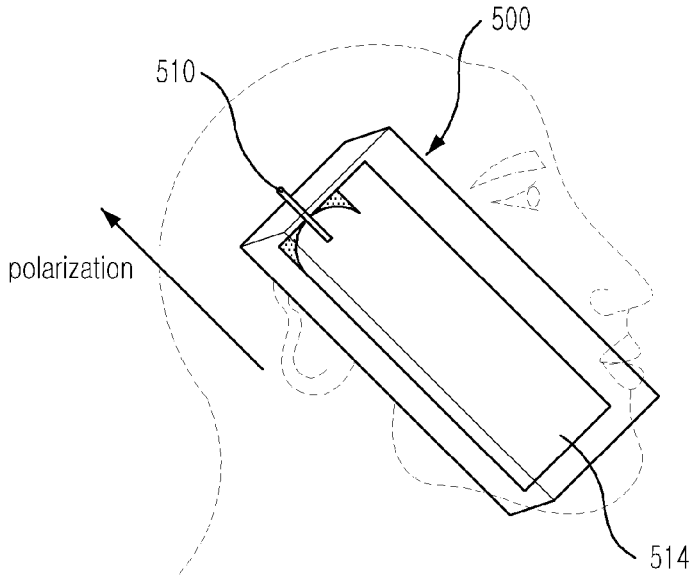
[Fig. 26]
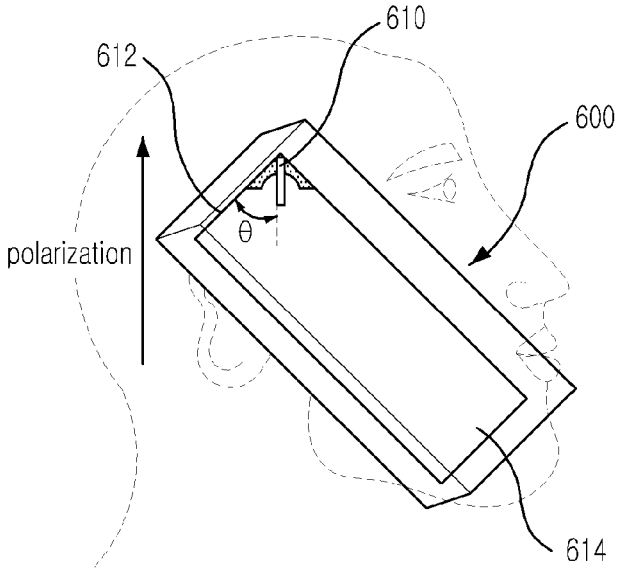

INVERTED L-SHAPED ANTENNA

TECHNICAL FIELD

The present invention relates to an inverted L antenna; and, more particularly, to an inverted L antenna for used in an ultra wideband system such as a broadband communication terminal and a base station antenna wherein the inverted L antenna is used as a built-in antenna being capable of implementing a wideband communication terminal such as a code division multiple access (CDMA) and an orthogonal frequency division multiplexing and various services such as a personal communication system (PCS), a cellular compatible terminal, a global system for mobile communications (GSM) and CDMA compatible terminal and a PCS and an IMT-2000 compatible terminal by one antenna.

BACKGROUND ART

In an ultra wideband (UWB) communication system receiving a lot of interest in a recent communication system, there has been a need for developing an antenna having a more wide band characteristics, since an impulse signal is radiated and received to/from an air.

Conventionally, an inverted L antenna has been introduced for use in an UWB system.

FIG. 1 is a diagram showing one of conventional inverted L antennas in accordance with a prior art.

As shown, the conventional inverted L antenna 100 includes an antenna element 120 coupled to an edge portion A, represented by a dotted circle, of a printed circuit board (PCB) 110. The PCB 110 includes a metal layer 111, a dielectric layer 113 and a ground layer 115. An output signal is electrically passed to the antenna element 120 through a feeding line 130.

The conventional inverted L antenna 100 radiates a microwave for communicating with other communication system by using an electric field excited at the edge portion A, which is called as an exciting area of the PCB 110.

FIG. 2 is a graph showing a performance of the conventional inverted L antenna based on a S11 parameter characteristic, wherein the graph is plotted the change of S11, representing a ratio between an amount of signal inputted the inverted L antenna and an amount of signal reflected from the inverted L antenna, in response to a frequency.

As shown, although a height-to-length (H/L) ratio of the inverted L antenna becomes very low, the inverted L antenna is outperformed in antenna efficiency, a voltage standing-wave ratio (VSWR) and an antenna gain deviation.

FIG. 3 is a graph of a gain of a conventional inverted L antenna versus a radiation frequency thereof, wherein a solid line represents an absolute value of the gain, whereas a dotted line represents gain characteristics of a component of radiation wave polarized along a direction of the antenna element.

In FIG. 3, the gain of absolute value is compared to the gain of the component of radiation wave polarized along a direction of antenna element. The gain characteristic of the conventional inverted L antenna shows that a mass electric field of a polarization component vertically polarized to the direction of the antenna element is strongly excited at a high frequency range. That is, the electric field strongly excited at the edge portion A of the PCB 110 generates an interference with the polarization of the antenna element. The gain characteristic causes to reduce a receiving performance.

Therefore, a receiving sensitivity of the conventional inverted L antenna becomes to decrease, which will, in turn, limit a communication area when the conventional inverted L antenna is applied to the UWB communication system.

DISCLOSURE OF THE INVENTION

Technical Solution

It is, therefore, an object of the present invention to provide an inverted L antenna having an antenna element coupled to a portion of printed circuit board in such a way that the portion dominantly generates an electric field parallel to an electric field generated by the antenna element.

In accordance with an aspect of the present invention, there is provided an inverted L antenna with fixed polarization, including: a printed circuit board (PCB) including an metal layer, a dielectric layer and a ground layer; and an antenna element coupled to a predetermined shaped of one side of the PCB, wherein the predetermined shape is a form for directing an electric field excited at edge of PCB to match with a direction of the antenna element.

In accordance with another aspect of the present invention, there is also provided an inverted L antenna including: a printed circuit board provided with at least one metal layer; and an N number of antenna elements coupled to a corresponding number of portions of the metal layer in such a way that each of the portions dominantly generates an electric field parallel to an electric field generated by a corresponding antenna element, wherein N is a positive integer.

In accordance with further another aspect of the present invention, there is also provided a mobile terminal including: a printed circuit board provided with a metal layer; and an antenna element coupled to a corner edge of the metal layer in such a way that the corner edge dominantly generates an electric field parallel to an electric field generated by the antenna element, wherein the direction of electric field generated at the antenna element is approximately perpendicular to a surface of an earth.

DESCRIPTION OF DRAWINGS

The above and other objects and features of the present invention will become better understood with regard to the following description of the preferred embodiments given in conjunction with the accompanying drawings, in which:

FIG. 1 is a diagram showing a conventional inverted L antenna;

FIG. 2 is a graph showing a performance of the conventional inverted L antenna based on a S11 parameter characteristic;

FIG. 3 is a graph showing a comparison between an absolute value of gain and a gain of a component of a polarization direction of a conventional inverted L antenna;

FIG. 4 is a perspective view illustrating an inverted L antenna in accordance with a preferred embodiment of the present invention;

FIG. 5 is a graph of a performance of an inverted L antenna in accordance with another preferred embodiment of the present invention;

FIG. 6 shows a graph of an inverted L antenna in accordance with another preferred embodiment of the present invention;

FIG. 7 is a graph showing a comparison between absolute value of a gain and a gain of a component of a polarization direction of an inverted L antenna in accordance with another preferred embodiment of the present invention;

FIGS. 8 to 15 are diagrams showing various implementing examples of PCB in accordance with various aspects of the present invention;

FIG. 16 is a diagram showing an inverted L antenna in accordance with another preferred embodiment of the present invention;

FIGS. 17 to 20 are diagrams showing examples of an inverted L antenna implementing structure in accordance with other aspects of the present invention;

FIGS. 21 to 24 show examples of an inverted L antenna implementing structures in accordance with other aspects of the present invention; and FIGS. 25 and 26 are diagrams for explaining a polarization direction of an inverted L antenna installed in a mobile station.

MODE FOR INVENTION

Hereinafter, an inverted L antenna according to the present invention will be described in more detail with reference to the accompanying drawings.

FIG. 4 is a perspective view illustrating an inverted L antenna in accordance with a preferred embodiment of the present invention.

As shown, the inverted L antenna 400 includes an antenna element 420 is coupled to a printed circuit board (PCB) 410. The PCB 410 includes a metal layer 411, a dielectric layer 413 and a ground layer 415. A signal inputted from electronic circuits formed on the PCB 410 is electrically passed to the antenna element 420 through a feeding line 430. An edge portion B of the metal layer 411 and the ground layer 415 are formed in a shape of a semi-circle. The antenna element 420 is coupled to the edge portion B of the metal layer 411.

By forming the edge portion B of the metal layer 411 as the semi-circle, an electric field excited at the edge portion B is dominantly generated along a direction identical to that of the antenna element 420, wherein the direction of the antenna element 420 is a Z-direction. That is, a direction of electric field excited at the semi-circle shape of the edge portion B is formed in a direction parallel to the direction Z of electric field of the antenna element 420.

As used in this description and in the appended claims, the word 'polarization of antenna' means a direction of an electric field that is generated at the antenna element 420.

FIG. 5 is a graph showing a performance of an inverted L antenna in accordance with a preferred embodiment of the present invention, wherein the graph is plotted based on the changes of the S11 representing a ratio between an amount of a signal inputted to the inverted L antenna and an amount of a signal reflected from the inverted L antenna.

The graph shown in FIG. 5 is plotted in case when a ratio of length-to-height as 2.0.

As shown, the inverted L antenna of the present invention is capable of operating at a very wide bandwidth (e.g., a bandwidth having a gain of −10 dB is spread in a range from approximately 35 GHz to 6 GHz). Therefore, the inverted L antenna of the present invention maintains broadband characteristics even the height H is very low.

FIG. 6 shows an efficiency of an inverted L antenna in accordance with a preferred embodiment of the present invention.

As shown in FIG. 6, the inverted L antenna of the present invention maintains more than 90% antenna efficiency at a bandwidth ranging from 35 GHz to 6 GHz.

FIG. 7 is a graph showing absolute gains as a solid line and polarizations of broadband inverted L antenna as a dotted line in accordance with a preferred embodiment of the present invention.

As shown in FIG. 7, two lines of the absolute gains and the polarizations are exactly matched each other. It means that the polarizations of the antenna element are not disturbed by the electric field excited at the excitation area in a bandwidth between 35 GHz to 6 GHz and a gain deviation is in a rage of +2 dB to −2 dB.

Therefore, the inverted L antenna of the present invention has a wideband antenna characteristics satisfying appropriate gain deviation as below −10 dB according to a polarization in a bandwidth between 35 GHz to 6 GHz. Therefore, the inverted L antenna of the present invention can increase receiving sensitivity of antenna comparing to the conventional inverted L antenna and a communication area of the inverted L antenna of the present invention can be wider than the conventional inverted L antenna.

FIGS. 8 to 15 are diagrams showing various implementing examples of forming edge of PCB in accordance with a preferred embodiment of the present invention.

FIGS. 8 to 11 show various shapes of the upper edge of the PCB 410. The shape of an upper edge of the PCB 410 is not limited to a form of semi-circle. The form can be various shapes such as a semi-circle, a triangle, an oval that structurally modifying a direction of electric field at an excitation area to match with a direction of broadband inverted L antenna.

FIGS. 12 to 15 show structures of a PCB where an inverted L antenna is coupled in accordance with a preferred embodiment of the present invention.

As shown in FIGS. 12 to 15, upper edges of a metal layer 410 and a ground layer 415 are formed as a semi-circle, a triangle, or an oval. And a rectangular shape of a dielectric layer 413 is extended to include the inverted L antenna. The rectangular shape of the dielectric layer 413 is extended to an end of the inverted L antenna for solidly attaching the inverted L antenna to the PCB.

In the preferred embodiment of the present invention, both of the metal layer 411 and the ground layer 415 are formed as a shape satisfying to modify a direction of electric field of an excitation area to match with a direction of broadband inverted L antenna. However, it is possible that the ground layer 415 can be implemented as a rectangular shape which is identical to the dielectric layer 413.

FIG. 16 is a diagram showing an inverted L antenna in accordance with another embodiment of the present invention.

As shown in FIG. 16, a semi-circle shaped additional metal layer 917 and a semi-circle shaped additional ground layer 919 are coupled to a side of a PCB 910. An antenna element 920 is coupled to both of the semi-circle shaped metal layer 917 and the side of the PCB 910. When the PCB 910 is large, the semi-circle shape additional metal layer 917 and the semi-circle shape additional ground layer 919 can be coupled to a portion of the side of the PCB 910 to modify a direction of electric field of an excitation area to match with a direction of the antenna element 920. As mentioned before, the form is not limited to a semi-circle.

FIGS. 17 to 20 are diagrams showing examples of an inverted L antenna implementing structure in accordance with another preferred embodiment of the present invention.

As shown in FIGS. 17 to 18, an antenna element is coupled to a semi-circle shaped upper middle of the PCB and a semi-circle shaped upper corner of the PCB for maintaining omni-directional radiation pattern of the inverted L antenna.

FIGS. 19 and 20 show another example of an inverted L antenna implementing structure.

In FIGS. 19 and 20, two antenna elements are coupled to an upper and bottom sides of the PCB. Two antenna elements are separately implemented as one for receiving and other for radiating.

FIGS. 21 to 24 show still another example of broadband inverted L antenna implementing structures in accordance with still another preferred embodiment of the present invention.

As shown in FIG. 21, the inverted L antenna is coupled to a semi-circle shaped corner of a PCB. The inverted L antenna of the FIG. 21 can increase the receiving performance, when it is implemented to a mobile phone. By coupling the antenna element coupled to the semi-circle shaped corner of the PCB within a predetermined angle such as 45°, a direction of polarization of the antenna will be matched with a direction of polarization of an antenna in a base station. In FIG. 22, two antenna elements are coupled in each corner of upper side of the PCB for implementing one for receiving and other for radiating. Two antennas are coupled in such a way a direction of electric field of an antenna element is maintained in about 90° angle to a direction of electric field of another antenna element.

In FIG. 23, two antenna elements are coupled to each corner of a left side of the PCB for maintaining a maximum distance allowable between two antennas.

In FIG. 24, four broadband inverted L antennas are coupled to four corners of the PCB for eliminating diversity problem. The inverted L antenna implementing structures in FIGS. 25 to 26 are structures for minimizing the coupling amount by maintaining a maximum allowable distance between the transmitting antenna and the receiving antenna.

FIGS. 25 and 26 are diagrams showing an inverted L antenna of the present invention installed in a mobile phone.

A mobile phone 600 of FIG. 26 has better receiving sensitivity than a mobile phone 500 of FIG. 12A.

As shown in FIG. 26, the mobile phone 600 includes an antenna element 610 couple to a corner of a metal layer 614. The antenna element 610 is coupled within approximately 45° to a side edge line 612. A direction of electric field of the inverted L antenna is maintained at approximately 90° to a surface of the earth which is similar or identical to a direction of electric field of an antenna in a base station which transmits a signal to the mobile phone 600. However, a direction of electric field of an antenna element 510 of the mobile phone 500 is maintained about 45° to the surface of the earth which is not similar to the direction of electric field of an antenna in a base station which transmits a signal to the mobile phone. Therefore, the mobile phone 600 has better receiving sensitivity than the mobile phone 500.

As mentioned above, the inverted L antenna can increase the receiving sensitivity by directing electric field excited at an edge of the PCB to match with a direction of the antenna element.

Therefore, the inverted L antenna of the present invention can be used for wideband communication terminal such as a code division multiple access and an orthogonal frequency division multiplexing and various services such as a personal communication system, a cellular compatible terminal, GSM and CDMA compatible terminal and a PCS and an IMT-2000 compatible terminal.

Furthermore, the inverted L antenna can be manufactured as a small sized and thus, it can be used at a potable MP3 player or a potable memory.

The present application contains subject matter related to Korean patent application No. KR 2003-0096884, field in the Korean patent office on Dec. 24, 2003, the entire contents of which being incorporated herein by reference.

While the present invention has been described with respect to certain preferred embodiments, it will be apparent to those skilled in the art that various changes and modifications may be made without departing from the spirit and scope of the invention as defined in the following claims.

The invention claimed is:

1. An inverted L antenna comprising:

a printed circuit board (PCB), wherein the PCB is substantially planar along an x-axis and a z-axis, the PCB is provided with a metal layer, a dielectric layer and a ground layer, the PCB has a main body and a tapered edge protrusion, the tapered edge protrusion having a corresponding apex positioned furthest away from the main body, the tapered edge protrusion comprising a portion of the metal layer and a portion of the ground layer, the tapered edge protrusion configured to provide an edge electric field substantially oriented along the z-axis; and an antenna element coupled to the metal layer, wherein the antenna element overlaps the apex and part of the tapered edge protrusion, and a portion of the antenna element extends away from the PCB beyond the apex along the z-axis, such that the antenna element is configured to provide an antenna electric field oriented along the z-axis.

2. The inverted L antenna of claim 1, wherein the tapered edge protrusion is a semi-circle shaped tapered edge protrusion.

3. The inverted L antenna of claim 1, wherein the tapered edge protrusion is a triangular shaped tapered edge protrusion.

4. The inverted L antenna of claim 1, wherein the tapered edge protrusion is an oval shaped tapered edge protrusion.

5. The inverted L antenna of claim 1, wherein the printed circuit board further includes:

the dielectric layer is formed on a bottom surface of the metal layer; and the ground layer formed on a bottom surface of the dielectric layer.

6. The inverted L antenna of claim 1 wherein the shape of the portion of the ground layer of the tapered edge protrusion is substantially equal to that of the shape the portion of the metal layer of the tapered edge protrusion.

7. The inverted L antenna of claim 1, wherein the tapered edged protrusion further comprises a portion of the dielectric layer.

8. The inverted L antenna of claim 1, wherein the electric field generated at the portion is caused by a signal inputted from an electric device mounted on the printed circuit board.

9. The inverted L antenna of claim 6, wherein the tapered edge protrusion further comprises a portion of the dielectric layer wherein the shape of the dielectric layer is substantially equal to that of the shape of the portions of the ground and metal layers.

10. The inverted L antenna of claim 6, wherein the tapered edge protrusion further comprises a portion of the dielectric layer wherein the shape of the dielectric layer is not substantially equal to that of the shape of the portions of the ground and metal layers.

11. An inverted L antenna comprising:

a printed circuit board (PCB), wherein the PCB is substantially planar along an x-axis and a z-axis, the PCB is provided with a metal layer, a dielectric layer and a around layer, the PCB has a main body and a plurality of tapered edge protrusions, each tapered edge protrusion having a respective apex positioned furthest away from the main body, each tapered edge protrusion comprising a portion of the metal layer and a portion of the around layer, each tapered edge protrusion configured to provide a corresponding edge electric field substantially oriented along the x-z plane; and a plurality of antenna elements coupled to the metal layer, wherein each antenna element overlaps part of one corresponding tapered edge protrusion and overlaps the respective apex of the one corresponding tapered edge protrusion, a part of each antenna element extends away from the PCB beyond the respective apex of the one corresponding tapered edge protrusion along the x-z plane, such that each antenna element is configured to provide a corresponding antenna electric field oriented along the x-z plane.

12. The inverted L antenna of claim 11, wherein each tapered edge protrusion is a semi-circular shape.

13. A mobile terminal comprising:

a printed circuit board (PCB), wherein the PCB is substantially planar along an x-axis and a z-axis, the PCB is provided with a metal layer, a dielectric layer and a ground layer, the PCB has a main body and a tapered edge protrusion, the tapered edge protrusion having a corresponding apex Positioned furthest away from the main body, the tapered edge protrusion comprising a Portion of the metal layer and a portion of the ground layer, the tapered edge protrusion configured to provide an edge electric field substantially oriented along the x-z plane; and an antenna element coupled to the metal layer, wherein the antenna element overlaps the apex and Part of the tapered edge protrusion, and a portion of the antenna element extends linearly away from the PCB beyond the apex along the x-z plane, such that the antenna element is configured to provide an antenna electric field oriented along the x-z plane.

14. The mobile terminal of the claim 13, wherein the antenna element is arranged in such a way that it is inclined at a predetermined angle away the PCB.

15. The mobile terminal of claim 14, wherein the predetermined angle is approximately 45 degrees.

* * * * *